US007107703B1

(12) United States Patent
Wang

(10) Patent No.: US 7,107,703 B1
(45) Date of Patent: Sep. 19, 2006

(54) SHOE SOLE

(76) Inventor: Yan Wang, 8A Village Loop, PMB #537, Pomona, CA (US) 91766

( * ) Notice: Subject to any disclaimer, the term of this patent is extended or adjusted under 35 U.S.C. 154(b) by 312 days.

(21) Appl. No.: 10/829,629

(22) Filed: Apr. 23, 2004

(51) Int. Cl.
*A43B 13/12* (2006.01)

(52) U.S. Cl. ..... 36/30 R; 36/25 R; 36/9 R; 12/146 B

(58) Field of Classification Search ..... 36/25 R, 36/30 R, 9 R, 9 A; 12/146 B, 142 G
See application file for complete search history.

(56) References Cited

U.S. PATENT DOCUMENTS 1,704,281 A * 3/1929 Capezio ..... 36/8.3
3,654,065 A * 4/1972 Dorogi ..... 442/77
4,915,766 A * 4/1990 Baxter ..... 156/335
5,840,309 A * 11/1998 Herstein et al. ..... 424/728
6,083,586 A * 7/2000 Andersen et al. ..... 428/36.4
6,162,966 A * 12/2000 Kossmann et al. ..... 800/284
6,491,966 B1 12/2002 Lisec
6,665,955 B1 12/2003 Mizrahi

* cited by examiner

*Primary Examiner*—Marie Patterson

(57) ABSTRACT

The present invention is a shoe sole formed from cotton fabric and bonded together with what in the prior art was thought to be a water soluble glue. As used in the specific construction of the present invention, millet glue is not substantially water soluble after about a year's worth of water exposure and day to day use of footwear having the invention shoe sole.

10 Claims, 3 Drawing Sheets

SHOE SOLE

BACKGROUND OF THE INVENTION

The present invention relates to shoe soles, especially those made entirely from layers of natural fiber.

The prior art describes many forms of shoe soles. Typically, a shoe sole must be impervious to water for the comfort of the wearer. Where the user's foot is enclosed by a shoe top and a water impervious shoe sole, the water impervious layer traps the heat of the wearer's foot. In hot and humid climates, a user wear such shoes and suffer great discomfort from overheated feet. It is critical in such climates that water and air flow relatively freely through the shoe soles so that heat from a user's foot can escape the inside of the shoe.

Many shoes have a water impervious outer shoe sole with a porous inner shoe sole. These shoes are only partly effective in reducing a user's discomfort. In use, a user's weight is focused on a small surface area of the soles of the user's feet. Therefore, the user's foot necessarily compresses a porous inner sole necessarily reducing the porosity of the material. When the porosity of such an inner sole is effectively blocked off, the sole of the user's foot cannot exchange heat by convection through the shoe sole. A user's foot continues to work amidst trapped heat and perspiration within a shoe.

Contrary to this understanding, U.S. Pat. No. 6,665,955 describes a shoe sole having a water impervious inner sole and a textile outer sole. This appears to give a user the worst of all possible worlds.

U.S. Pat. No. 6,593,966 describes shoes with an inner sole of relatively light fleece water impervious shoe soles. desire a shoe sole that is cooler because such a sole is potentially water absorbing. the discomfort of having wet feet because of a non-water resistant shoe sole can be. Such a shoe sole must incorporate a layer that is impervious to Some varieties of cereals, such as barley, maize, millet, wheat, milo, rice and sorghum nearly completely consist of amylopectin. A common feature of adhesives from these cereals is water solubility. For some products, such as wallpaper glue, water solubility is desired and grain-derived pastes provide such easy solubility.

U.S. Pat. No. 6,162,966 states:

> By cereals particularly monocotyledonous plants belonging to the order Poales, preferably those of the family of Poaceae are to be understood. Examples of such plants are plants belonging to the genera *Avena* (oats), *Triticum* (wheat), *Secale* (rye), *Hordeum* (barley), *Oryza* (rice), *Panicum, Pennisetum, Setaria, Sorghum* (millet), *Zea* (maize) etc. . . . A major field of application is, for instance, in the adhesive industry, where the fields of application are subdivided into four areas: the use as pure starch glue, the use in starch glues prepared with special chemicals, the use of starch as an additive to synthetic resins and polymer dispersions as well as the use of starches as extenders for synthetic adhesives. 90% of all starch-based adhesives are used in the production of corrugated board, paper sacks and bags, composite materials for paper and aluminum, boxes and wetting glue for envelopes, stamps, etc.

It is well known to use all or a part of millet for an adhesive, even for gluing sheet layers together to make products like cardboard. However, these adhesives are not usable where they will be exposed to liquid water.

U.S. Pat. No. 5,840,309 states:

> Dextrins are used for numerous industrial applications. Some examples of relevant areas are the adhesive industry, the paper industry, the pharmaceutical industry, the mining industry, the food industry, and the textile industry. Sometimes a distinction is made between malto-dextrins and pyrodextrins. The first being the product of dextrinization of starch using an enzyme; the latter being the product of dextrinization of starch using heat [including treating millet with heat]. The large scale production of dextrins for non-food applications primarily concerns pyrodextrins.

The pyrodextrins formed from the amylopectins in millet can be made less soluble in water if combined with other components such as polymers. Unless changed in that way, a millet-based glue is certain to fail when exposed to water.

That idea was discussed in U.S. Pat. No. 4,915,766:

> The resin also typically will include thickeners, fillers and extenders. Powdered vegetable materials such as starch, nutshells (for example, walnut shells, pecan shells, coconut shells, ivory nut shells, horse chestnut shells, peanut shells, and the like), wood flours, barks, leaves, corn cob (Co Cob), rice hull and the like are usually mixed into the adhesive as fillers either alone or in combination with a diluent such as wheat flour (Glu X), sorghum flour and the like for preventing over penetration of adhesive into the wood veneer, for retaining a uniform adhesive viscosity to facilitate the spreading of the adhesive on the veneer surface, and for preventing the formation of interstices and cracks accompanying the shrinkage and aging of the cured resin after adhesion. Fillers often are used in an amount of from about 8 to 14% based on the weight of the phenolic resin.

Millet in that case is used only as a filler for the primary adhesive to glue layers of wood together.

U.S. Pat. No. 6,083,586 states:

> The term "sheet" as used in this specification and the appended claims is intended to include any substantially flat, corrugated, curved, bent, or textured sheet made using the compositions and methods described herein. The only essential compositional limitation is that the binding matrix comprises starch formed by gelatinizing starch granules during the sheet-making process. The starch-bound sheets may include organic coatings, printing, other sheets laminated thereto, etc. The starch-based sheets are preferably non-frangible such that they are not easily shattered. When starch is included in high enough amounts the resultant sheets are inherently not frangible or easily shattered. . . . Although starch is produced in many plants, the most important sources are seeds of cereal grains, such as corn, waxy corn, wheat, sorghum, rice, and waxy rice, which can also be used in the flour and cracked state.

The '586 patent indicates a desirable feature of starch bound sheets. They are not frangible or easily shattered. There is a need for a method and product by which the benefits of starch-based adhesives without water solubility.

SUMMARY OF THE INVENTION

The present invention is a shoe sole formed from highly compressed layers of cotton fabric bonded together with millet paste. After one year of use with heavy water exposure and machine washing, the shoe soles show surprisingly relatively little wear and no tendency to delaminate along the layers of cotton fabric. While the invention shoe sole is highly porous so that water freely absorbs into and evaporates from the shoe sole, this shoe sole retains its high porosity even while the weight of the user is focused on the soles of the user's feet. A unique structure arises in the shoe sole from the multi-layer bonding with millet paste. The shoe sole is sufficiently compressible for the comfort of the wearer. However, the firm, multi-layer structure does not lose its substantial porosity when the user walks on it. It is not intended that the invention shoe sole be bound to a water impervious layer. Such a water impervious layer would defeat the objects of the invention.

The benefits of a starch based adhesive have been realized in the present invention. The prior art starch based adhesive is not easily fractured or broken, although its use in a shoe sole was known to be of no value. Only imagine wearing cardboard shoe soles, where the starch-based adhesives dissolve on water exposure and the layers of the cardboard delaminate. It has been found a millet paste, preserved with a small amount of alum and sulfuric acid, can be effectively water insoluble in the layers of the shoe sole of the invention. Such a result was entirely unpredictable with reference to the prior art.

The process of forming the invention shoe sole is started by gluing together several relatively loosely woven cotton fabric sheets, such as is typical of cotton gauze in medical goods. Six to twelve of these fabric sheets are painted with the millet paste and are pressed together by hammering or heavy compression to form a single sole layer. The glue in the sole layers are allowed to dry. After drying, two to twenty sole layers are painted with the millet paste described above and stitched tightly together to form the entire inner and outer sole. These bound-together sole layers are preferably further manipulated so that one to three millimeters of their peripheral edges are folded inward, compressed and stitched together to form a very wear resistant sole edge.

Ramie twine or heavy thread is preferred for stitching together the sole layers at a stitching density of about 15 to 25 stitches per square inch. This natural fiber thread forms an extremely strong structural relationship with the sole layers. Loops of the stitching are exposed on the outer sole and so are worn down and the continuous stitching broken thereby. However, this apparently does not affect the resistance to wear and resistance to delamination by exposure to water.

Most important, the invention shoe sole is very effective in keeping the user's foot cool and well ventilated even in the hottest and most humid climates. A shoe upper bonded or stitched to the invention shoe sole forms a foot enclosing shoe. The invention shoe sole maintains its firmness while staying flexible and well ventilated as to the user's foot. The invention shoe sole absorbs water on surfaces where the user walks, although the surprising constant functional porosity of that shoe sole causes such water to quickly evaporate. A user's foot perspiration also absorbs into the inner part of the shoe sole, where the constant functional porosity cause such moisture to quickly evaporate and cool the user's foot.

DETAILED DESCRIPTION OF THE INVENTION

The invention is now discussed with reference to the figures.

Figure 1:
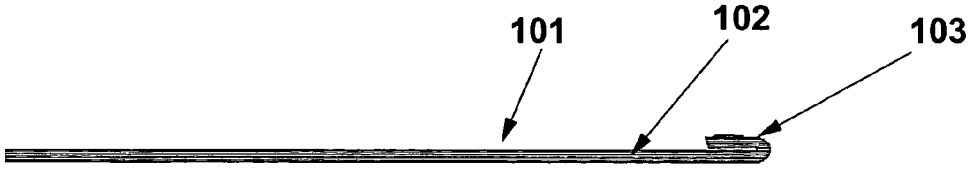
FIG. 1 is a side and cutaway view of a sole layer of the invention sole.

FIG. 1 shows a sole layer 101 comprising 4 to 20 layers of loosely woven cotton fabric (such as that used in medical gauze, more specifically in the range of 15 to 30 threads per inch) after being lightly painted with millet glue and hammered together with a wooden mallet or compressed mechanically. Sole layer 101 preferably comprises a flat portion 102 and a folded over portion 103. The folded over portion 103 defines the wear resistant edge of the invention shoe sole when multiple sole layers are stitched together.

The invention shoe sole uses a millet glue is preferably made from Shanxi millet cooked in water until soft and processed into a paste. To this paste is added up to about 2 weight percent of an equal parts mixture of alum and sulfuric acid as a preservative, although other preservatives could be used to prevent bacterial breakdown of the millet glue. This millet glue is lightly painted on the loosely woven cotton fabric before it is heavily compressed into a sole layer 101. Before further fabrication, the millet glue of each sole layer is allowed to completely dry. Although it does not completely saturate the loosely woven cotton fabric, the millet glue impregnates and is entirely absorbed into the natural fiber of the cotton fabric during the hammering step. It is believed that the hammering step so finely divides the millet glue that subsequent attack by water and mechanical manipulation do not affect the mechanical strength of the invention shoe sole.

Figure 2:
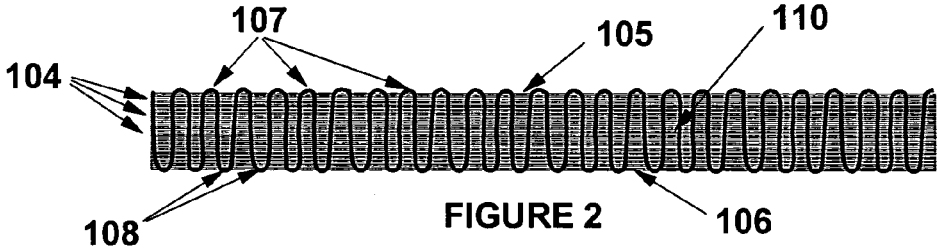
FIG. 2 is a side and cutaway view of several sole layers stitched together.

FIG. 2 shows sole layers 104 glued together with millet glue and stitched together with ramie twine or thread 110, resulting in an inner sole surface 105 with loop ends 107 and an outer sole surface 106 with loop ends 108. Loop ends 108 are exposed to abrasion and wear as a user uses a shoe made with the invention shoe sole. Prior art instructs that when a loop end 108 is worn through and broken, the sole layers 104 would tend to delaminate and cause the shoe sole to disintegrate. Surprisingly, the opposite occurs, as shown in drawing figures described below.

Figure 3:
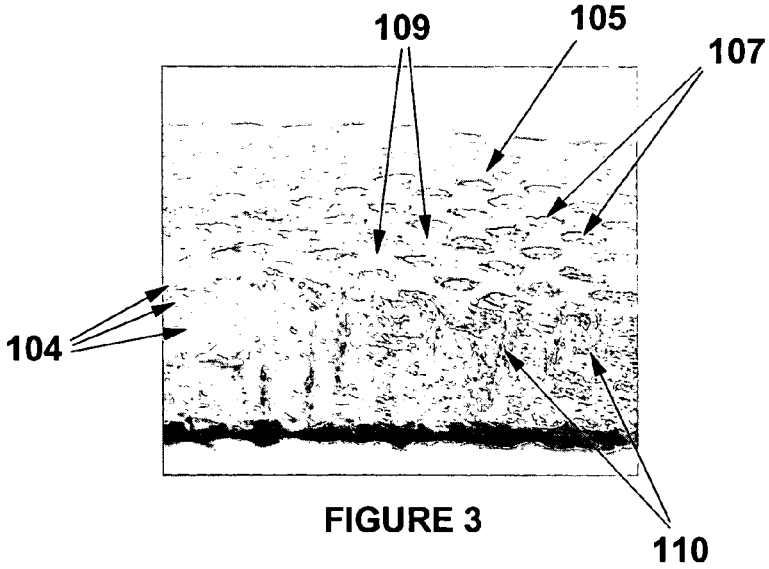
FIG. 3 is a perspective and cutaway view of the invention sole showing the cutaway side and inner sole surface.
Figure 4:
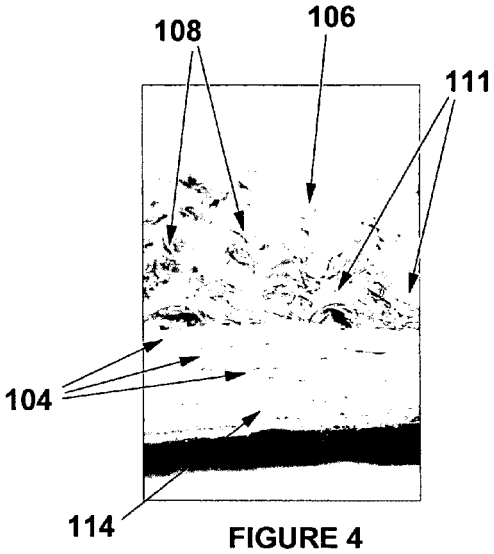
FIG. 4 is a perspective and cutaway view of the invention sole showing the outer edge side and outer sole surface.

FIG. 3 shows that fabric layer 109 and loop ends 107 make up the inner sole surface 105 and that ramie (*Boehmeria nivea*) twine or thread 110 forms stitch density of about 15 to 25 stitches per square inch of inner sole surface 105. FIG. 4 shows that fabric layer 111 and loop ends 108 make up the outer sole surface 106 and that ramie (*Boehmeria nivea*) twine or thread 110 forms stitch density of about 15 to 25 stitches per square inch of outer sole surface 106 (in FIG. 4). FIG. 4 also shows that a shoe sole defining edge 114 is formed from the overlapped edges 103 (shown in FIG. 1) glued together with millet glue and stitched together. This construction keeps the edges 114 tightly compressed in use and resists wear.

Figure 5:
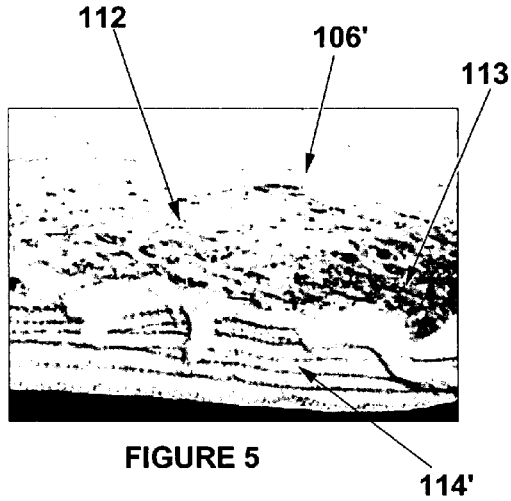
FIG. 5 is the a perspective and cutaway view of the invention sole of FIG. 4 after about a year of wear, machine washing and other water exposure.

FIG. 5 shows the shoe sole of FIG. 4 after about a year of everyday wear by a user in a hot, tropical climate, machine washing and other water exposure. Bottom sole surface 106' has a worn portion 112 and a relatively non-worn portion 113. It is easily seen that even though the invention shoe sole is somewhat worn down in the portion 112 where the balls of the user's foot press on the sole, the amount of total wear is minimal as edges 114' show that only one to one and half of eight sole layers have been worn through. Even more surprising is the lack of evidence of delamination from the action of water on the invention shoe sole held together with what is supposed to be water soluble glue.

Figure 6:
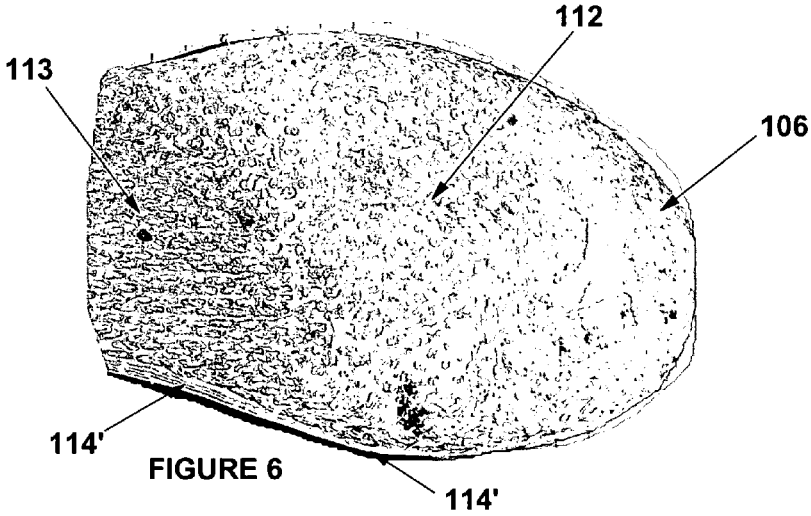
FIG. 6 is a bottom view of the part of invention shoe sole supporting the front part of the user's foot after about a year of wear, machine washing and other water exposure.
Figure 7:
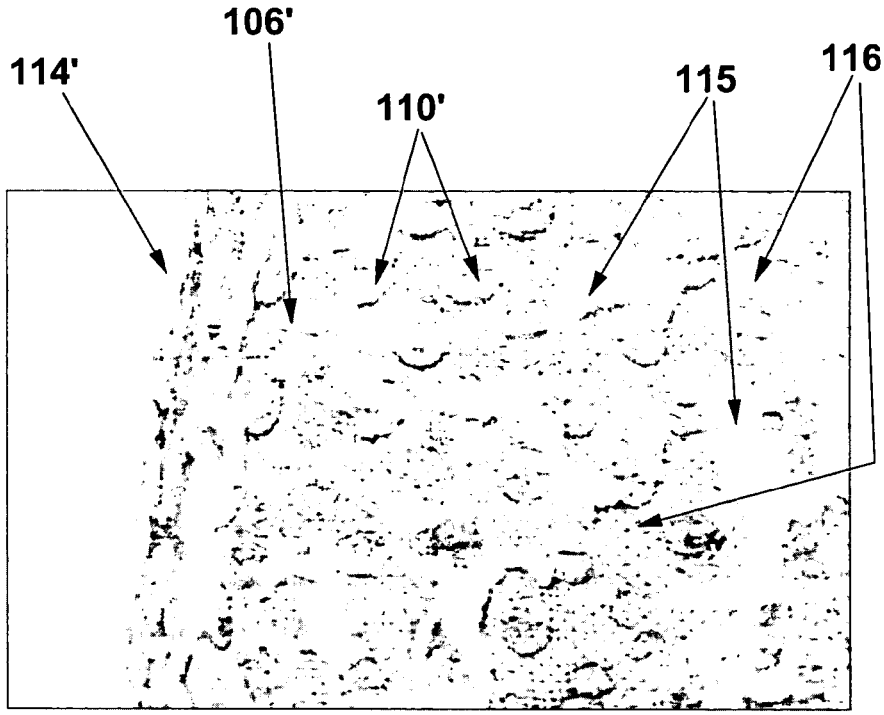
FIG. 7 is a closeup view of the shoe sole of FIG. 6 in the most worn part of the shoe sole.

FIG. 6 is a top view of the shoe sole of FIG. 5, where the smooth "feathering" transition between the worn and relatively unworn portions of the shoe sole show that delamination is not a significant problem for the invention shoe sole. FIG. 7 shows a close up of the worn portion of FIG. 6, where threads 110' are the worn down remains of loops 108 of the outer surface 106. Even though loops 108 do not now keep sole layers from coming apart, the composite construction of the sole layers held together with millet glue and relatively thick ramie thread have created the dramatic result shown in FIG. 7. Shreds of a fabric layer 115 are shown firmly attached on to an underlying fabric layer 116. The wear pattern illustrated by these features is not delamination expected from use of a water soluble glue, but one typical of use of a non-water soluble glue. The present construction transforms what the prior art describes as a water soluble glue into a non-water soluble glue. The present construction causes the twined ramie thread passing through the sole layers to become intimately bonded with surrounding cotton fibers. This special construction has been found to establish a substantially continuous and vertical connector between both sole layers and individual layers of cotton fabric even though the outside sole loop is worn through.

Figure 8:
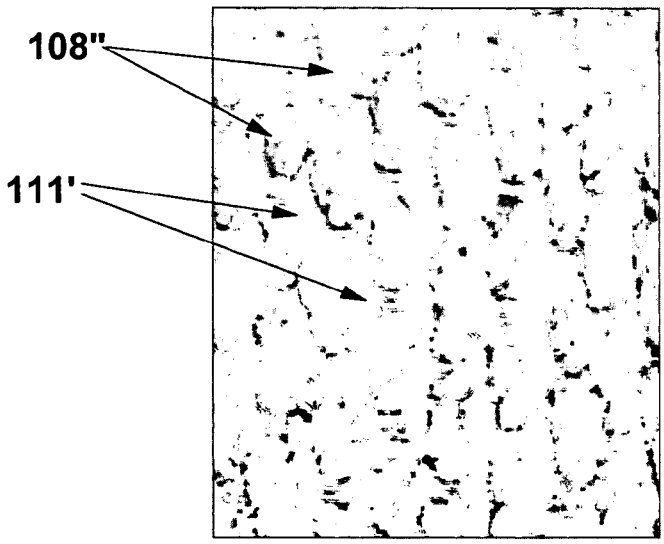
FIG. 8 is a closeup view of the shoe sole of FIG. 6 in the least worn part of the shoe sole.

FIG. 8 shows a closeup of the relatively unworn portion of the shoe sole of FIG. 5. This demonstrates that heavy mechanical stretching and twisting typical of a year's worth of use has little effect on the integrity of the original construction of the invention shoe sole.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

I claim:

1. A method for forming a shoe sole adapted to be attached to a shoe upper, the combination of which shall substantially cover a user's foot comprising:

(a) forming a millet glue from millet heated in water to form a paste and combined with an effective amount of preservative;

(b) forming two to twenty sole layers, each sole layer being formed by applying millet glue to four to twenty layers of loosely woven cotton fabric and heavily compressing together the layers of loosely woven cotton fabric; and (c) gluing together the sole layers and subsequently stitching the sole layers together at a stitching density of fifteen to twenty-five stitches per square inch.

2. The method of claim 1 wherein, before a sole layer is glued to another sole layer in step (b), a relatively small portion of a peripheral edge portion of each sole layer is folded inward on itself to form a defining edge.

3. The process of claim 2 wherein the loosely woven cotton fabric has a thread density of from fifteen to thirty threads per inch.

4. The process of claim 3 wherein a shoe upper is stitched to or bonded to an inner sole surface of the shoe sole.

5. A shoe sole comprising:

(a) two to twenty sole layers, each sole layer having been formed by applying millet glue to four to twenty layers of loosely woven cotton fabric and heavily compressing together the layers of loosely woven cotton fabric; and (b) the shoe sole having sole layers which have been glued together with millet glue and stitched together a stitching density of fifteen to twenty-five stitches per square inch.

6. The shoe sole of claim 5 wherein the millet glue comprised millet heated in water to form a paste and combined with an effective amount of preservative.

7. The shoe sole of claim 5 wherein the loosely woven cotton fabric has a thread density of from fifteen to thirty threads per inch.

8. The shoe sole of claim 5 wherein no water impervious layer is incorporated into the shoe sole.

9. The shoe sole of claim 5 wherein a shoe upper is secured to the shoe sole, whereby an outer sole surface is defined with stitching loop ends exposed thereon.

10. The shoe sole of claim 9 wherein the stitching loop ends are adapted to by worn through without substantially affecting mechanical strength of the shoe sole.

* * * * *